US011707120B2

(12) United States Patent
Wright et al.

(10) Patent No.: US 11,707,120 B2
(45) Date of Patent: Jul. 25, 2023

(54) FASHION ACCESSORY AND KIT THEREFOR

(71) Applicant: PlayMonster Group, LLC, Beloit, WI (US)

(72) Inventors: Sheila A. Wright, Bloomfield Hills, MI (US); Jeannine Caesar, Royal Oak, MI (US); Colleen Elliott, Clawson, MI (US)

(73) Assignee: PlayMonster Group, LLC, Beloit, WI (US)

( * ) Notice: Subject to any disclaimer, the term of this patent is extended or adjusted under 35 U.S.C. 154(b) by 72 days.

(21) Appl. No.: 17/196,310

(22) Filed: Mar. 9, 2021

(65) Prior Publication Data

US 2021/0186166 A1 Jun. 24, 2021

Related U.S. Application Data

(63) Continuation-in-part of application No. 16/276,736, filed on Feb. 15, 2019, now Pat. No. 10,993,514.

(51) Int. Cl.
*A44C 11/00* (2006.01)

(52) U.S. Cl.
CPC ..... *A44C 11/00* (2013.01)

(58) Field of Classification Search
CPC . A44C 15/0025; A44C 25/007; A44C 27/007; A44C 3/008; A44C 15/004; A44C 25/00; A44C 25/001; B32B 2451/00; B32B 2519/00; B44C 1/105; G09F 3/02; G09F 3/10; G09F 2003/023

(Continued)

(56) References Cited

U.S. PATENT DOCUMENTS 840,487 A * 1/1907 Goldsmith ..... G09F 3/00 40/639
857,778 A * 6/1907 Wittstein ..... G09F 3/00 40/639

(Continued)

FOREIGN PATENT DOCUMENTS

EP 1988530 B1 11/2008
EP 3462975 A1 4/2019

OTHER PUBLICATIONS

ResinObsession.com, *Puffy sticker resin bracelet tutorial*, Aug. 7, 2014, https://www.resinobsession.com/resin-tutorials/puffy-sticker-resin-bracelet-tutorial/, Accessed Jan. 4, 2019.

(Continued)

*Primary Examiner* — Jack W Lavinder
(74) *Attorney, Agent, or Firm* — Lathrop GPM LLP; William T. Griffith

(57) ABSTRACT

A fashion accessory and kit for the same. The fashion accessory comprises a first adhesive decoration and a second adhesive decoration connected at an interface. A seam extends at least partially a length of the interface. Each of the first adhesive decoration and second adhesive decoration comprise a face and a back, the face including a design. The first adhesive decoration and second adhesive decoration comprise foam, the foam extending between the face and the back. The first adhesive decoration and second adhesive decoration are mated, back-to-back, to form a charm.

15 Claims, 9 Drawing Sheets

(58) Field of Classification Search
USPC ..... 63/21, 23
See application file for complete search history.

(56) References Cited

U.S. PATENT DOCUMENTS 1,742,982 A * 1/1930 Wittstein ..... G09F 3/12 40/639
4,419,395 A 12/1983 Sugimoto
4,419,396 A 12/1983 Sugimoto
4,526,820 A * 7/1985 Haas ..... B60R 13/005 220/4.23
5,233,845 A 8/1993 D'Andrade
5,444,994 A 8/1995 Poortinga et al.
5,491,006 A 2/1996 Johnson
6,073,758 A * 6/2000 Webster ..... B65D 73/0071 206/523
6,426,139 B1 * 7/2002 Ezra ..... B43K 29/00 428/347
7,015,815 B1 * 3/2006 Feibelman ..... G08B 13/2434 340/568.1
10,475,357 B2 11/2019 Kimes
2002/0073516 A1 * 6/2002 Behar ..... A47B 21/06 24/306
2003/0201893 A1 10/2003 Redbum
2003/0208148 A1 11/2003 Sullivan
2006/0037358 A1 2/2006 Zuffoletto
2007/0277433 A1 * 12/2007 Stearns ..... G09F 3/10 47/58.1 R
2010/0003477 A1 1/2010 Lee
2012/0312718 A1 12/2012 Canright
2015/0164190 A1 6/2015 Zaritisky et al.
2016/0157578 A1 6/2016 Ricci et al.
2016/0213186 A1 7/2016 Rezny
2018/0352919 A1 12/2018 Cucchiara
2019/0053586 A1 2/2019 Potash et al.

OTHER PUBLICATIONS

MelissaAndDoug.com, *Design-Your-Own Bracelets*, https://www.melissaanddoug.com/design-your-own-bracelets/4217.html, Accessed Jan. 4, 2019.
GageGirl.com, *Dec. 2017 Cocoa Daisy Dori Standard Kit*, Nov. 29, 2017, http://www.gagegirl.com/planners/december-2017-cocoa-daisy-dori-standard-kit/, Accessed Jan. 4, 2019.

* cited by examiner

FASHION ACCESSORY AND KIT THEREFOR

FIELD

The present teachings generally relate to a fashion accessory, a kit comprising components of the fashion accessory, and method for constructing the fashion accessory. More specifically, the present teachings relate to a fashion accessory, kit, and method utilizing three dimensional adhesive pieces and specifically adhesive decorations for the imaginative construction of wearable articles.

BACKGROUND

Jewelry making is an activity enjoyed by children as an outlet to express creativity and produce a final product that can be worn, displayed, and enjoyed over time. Charms have been used to enhance jewelry and customize the jewelry's appearance while maintaining the option to remove or replace charms with ease.

Conventional charms are provided as single pieces, which lack individual customizability. Furthermore, the selection of the wearable article (e.g., necklace) upon which the charm is configured to attach may be limited. Conventional charms are also constructed from expensive materials and as a result, providing for a large quantity of charms in a single kit is cost prohibitive.

Some jewelry making kits may be difficult to use by younger children or persons lacking a certain amount of hand-eye coordination or fine motor skills. For these users, different product configurations that reduce the number of individual parts or aid in assembly would be helpful to properly assemble jewelry.

It would be desirable to provide a fashion accessory comprising charms, wherein the charms are customizable. It would be desirable to provide a fashion accessory whereby the wearable article and the charms are constructed from materials that provide for a wide variety of choices in constructing the fashion accessory without being cost-prohibitive. It would be desirable to provide a fashion accessory where charms may be connected to a variety of wearable articles. It would be desirable to provide charms having adhesive decorations connected together to aid users in their assembly.

SUMMARY

The present disclosure relates to a fashion accessory, which may address at least some of the needs identified above, the fashion accessory comprising: at least a first adhesive decoration and a second adhesive decoration connected at an interface; and a seam extending at least partially a length of the interface; wherein each of the at least first adhesive decoration and second adhesive decoration comprise a face and a back, the face including a design; wherein the at least first adhesive decoration and second adhesive decoration comprise foam, the foam extending between the face and the back; and wherein the at least first adhesive decoration is mated, back-to-back, with the second adhesive decoration to form a charm.

The present disclosure relates to a kit for a fashion accessory, which may address at least some of the needs identified above, the kit comprising: a first adhesive decoration and a second adhesive decoration connected at an interface; and one or more wearable articles; wherein a seam extends at least partially a length of the interface, the seam being formed by scoring, compressing, pre-folding, perforating, or any combination thereof; wherein each of the first adhesive decoration and second adhesive decoration comprise a face and a back, the face including a design; wherein the first adhesive decoration and second adhesive decoration comprise foam, the foam extending between the face and the back; wherein the first adhesive decoration and second adhesive decoration include one or more attachment members integrally formed thereto, the one or more attachment members including a lobe extending distally from the first adhesive decoration and second adhesive decoration, the lobe including a through-hole extending therethrough; wherein the interface is located on, opposite, and/or adjacent to the one or more attachment members, on a portion of respective edges of the first adhesive decoration and second adhesive decoration, or both; wherein the back includes a peel and stick adhesive thereon; wherein the peel and stick adhesive is selected from a rubber, an acrylic, an acrylic blend, an epoxy, a one-part adhesive, a two-part adhesive, or any combination thereof; and wherein the first adhesive decoration is mated, back-to-back, with the second adhesive decoration to form a charm.

A method for constructing the fashion accessory including: folding the first adhesive decoration and the second adhesive decoration along the seam; and mating the first adhesive decoration, back-to-back, with the second adhesive decoration to form a charm.

DESCRIPTION

Figure 1:
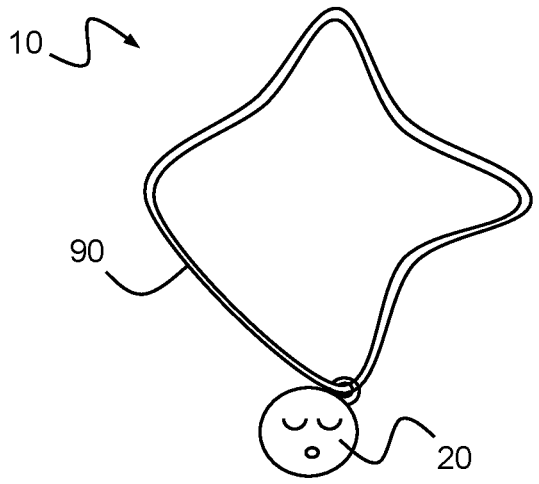
FIG. 1 is a plan view of a fashion accessory.

The present teachings meet one or more of the above needs by providing one or more fashion accessories, one or more kits, and a method described herein. The explanations and illustrations presented herein are intended to acquaint others skilled in the art with the teachings, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the description herein, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present disclosure provides for one or more fashion accessories. The fashion accessory may function to provide a user with a creative outlet to construct functional, wearable articles having charms. The fashion accessory may be provided as a kit comprising individual components configured to be assembled by employing the method of the present disclosure. The fashion accessory may include one or more charms, adhesive decorations, attachment members, wearable articles, auxiliary decorations, or any combination thereof. The fashion accessory may generally include a wearable article with one or more charms attached via one or more attachment devices, attachment members, or both. The fashion accessory may include one or more wearable articles and one or more charms. For example, the fashion accessory may include several necklaces and a plurality of adhesive decorations to provide for the construction of multiple wearable articles with any combination of charms. As another example, the fashion accessory may include a set of different types of wearable articles (e.g., bracelets, necklaces, earrings, rings, pins, anklets, belts, hair decorations). The fashion accessory may include components that are intended for use with or are only compatible with certain other components of the fashion accessory. For example, larger charms may be intended for use with a necklace, whereby the larger charm is intended as a central pendant of a necklace. As another example, a charm may have an attachment member that is compatible only with a certain type of attachment device (e.g., a large diameter split ring may only be compatible with a charm having an attachment member of comparable size). While the configuration of the individual components of the fashion accessory may be intended for a particular use, as described above, such configuration may represent only a pre-determined (by the manufacturer) method by which the fashion accessory is to be configured but the crafter may assemble the fashion accessory in any way they so desire.

The fashion accessory may be enjoyed primarily by children, but adults may also participate in interacting with the fashion accessory. The fashion accessory may be employed to capture the attention of the user and provide an outlet for creativity. The fashion accessory may be enjoyed upon initial assembly and even beyond initial assembly. For example, the fashion accessory may be enjoyed beyond initial assembly by removing and replacing charms with respect to the wearable article. The charms of the fashion accessory may be traded amongst children having their own fashion accessories. The fashion accessory may be enjoyed for the purpose of fashion, dress-up, conveying moods (e.g., selecting an emoji charm reflecting the wearer's mood for the day and attaching it to the wearable article), or any combination thereof. Charms that are lost or damaged may be easily replaced by assembling new charms and attaching them to the wearable article.

The present disclosure provides for a kit for a fashion accessory as described herein. The kit may include a plurality of adhesive decorations, one or more wearable articles, one or more attachment devices, one or more auxiliary decorations, or any combination thereof. The kit may comprise only adhesive decorations, the kit may be a refill kit to complement a kit having all of the aforementioned elements, or both. The refill kit may provide for charms that may be attached to wearable articles already possessed by the crafter from an original kit. The refill kit may further include one or more attachment devices, which replace lost or broken attachment devices from an original kit. The kit or refill kit may include charms having a single theme or a mix of themes. For example, the kit or refill kit may provide only charms configured with a medieval theme (e.g., castles, dragons, princesses, horses, swords, knights, weapons, and the like). As another example, the kit or refill kit may provide charms having the different themes of creatures, numbers, letters, and faces.

The fashion accessories discussed herein may be created via a method discussed herein. The method may include one or more of the steps discussed herein. Some of the steps may be duplicated, removed, or eliminated, rearranged relative to other steps, combined into one or more steps, separated into two or more steps, or any combination thereof. The method may include a step of applying a first adhesive decoration to a second adhesive decoration to form a charm and a step of affixing the charm to a wearable article. The step of affixing the wearable article to the charm may be performed in the same step as applying a first adhesive decoration to a second adhesive decoration. The wearable article or a portion thereof may be located between a back of the first adhesive decoration and a back of the second adhesive decoration and thereafter the first adhesive decoration may be applied to the second adhesive decoration so that the wearable article is sandwiched between the first and second adhesive decoration. The first adhesive decoration and second adhesive decoration may be folded, at a seam, onto a wearable article, a body part, clothing, or any combination thereof. The first adhesive decoration and second adhesive decoration may be translated along an attachment device. The first adhesive decoration and second adhesive decoration may be translated along an attachment device into position on opposing sides of a wearable article, a body part, clothing, or any combination thereof. The first adhesive decoration and second adhesive decoration may be disposed back-to-back onto an attachment device. The step of affixing the wearable article to the charm may be performed by applying the wearable article to one or more attachment members of the charm. For example, a wearable article comprising a string may be strung through an attachment member (e.g., an integral loop) of the charm. A wearable article may be extended between a first adhesive decoration and a second adhesive decoration and the first adhesive decoration and the second adhesive decoration connect together sandwiching the wearable article therebetween to form a connection. The step of affixing the wearable article to the charm may comprise applying an attachment device to one or more attachment members of one or more charms. The attachment device may be applied to the wearable article. The method may include a step of applying a wearable article to a body part of a user. The method may include a step of applying a wearable article to a decorated article. For example, the attachment device may include a split ring that is threaded through both the attachment member of the charm and the wearable article. All or a portion of a wearable article may be extended through the attachment member to form a connection. Any of the aforementioned steps may be repeated for a plurality of first adhesive decorations and a plurality of second adhesive decorations; wherein a plurality of charms may be affixed to one wearable article or a plurality of wearable articles. The method may include a step of removing a backing from the adhesive decoration so that the tacky substance is exposed. The method may include a step of punching out a center of a die cut attachment member. The method may include a step of cutting a slit in the attachment member to open the attachment member so that the wearable article, attachment device, or both may be pushed through the slit to form a connection between the attachment member and the wearable article. A cut attachment member may be wrapped around one or more wearable articles to form a connection. The method may include a step of removing a charm from a first wearable article and attaching the charm to a second wearable article. The method may include stringing a shoelace through a wearable article by stringing the shoelace through an attachment member on a first lobe of the wearable article and then through an attachment member on a second lobe of the wearable article. The method may include a step of assembling a wearable article (e.g., cutting a length of string from a larger length of string, braiding string together, attaching a closure device (i.e., a device for securing the wearable article on a body part of the wearer) to the wearable article, and/or tying the wearable article into knots to create loops). The method may include a step of decorating the fashion accessory with auxiliary decoration. The step of decorating the fashion accessory with auxiliary decoration may comprise decorating the adhesive decorations, decorating the wearable article, or both. The step of decorating the wearable article with auxiliary decoration may include stringing beads on the wearable article, affixing pre-assembled charms to the wearable article, applying pendants to the wearable article, or any combination thereof. The step of decorating the adhesive decorations may be performed before or after the first adhesive decoration and second adhesive decoration are assembled to form a charm. The step of decorating the adhesive decorations may include painting the adhesive decoration, drawing on the adhesive decoration, or both.

The adhesive decorations may function to form a charm in an assembled state. The adhesive decorations may be provided as a set of adhesive decorations with complementary pairs of first adhesive decorations and second adhesive decorations. There may be any number of complementary pairs of adhesive decorations in a set. The complementary pairs may comprise the same theme, the same design, different themes, different designs, or any combination thereof. For example, a set of adhesive decorations may include a dozen pairs each having the same emoji face (same theme and same design). As another example, a set of adhesive decorations may include a dozen pairs each having emoji faces having different expressions (same theme, different design). As yet another example, a set of adhesive decorations may include a dozen pairs each having a different design chosen from an object, animal, figure, and setting (different theme, different design).

A charm may include a pair of adhesive decorations. A pair of adhesive decorations may cooperate together to form a single charm. A pair of adhesive decorations may include a first adhesive decoration and a second adhesive decoration. A pair of adhesive decorations may have substantially reciprocal profiles. A pair of adhesive decorations may comprise two adhesive decorations exhibiting reflection symmetry. Reflection symmetry may be with respect to a reflection plane disposed between and equidistant from the adhesive decorations. Due to reflection symmetry, when the adhesive decorations are applied together back-to-back, the profiles of the adhesive decorations align. Reflection symmetry may ensure that portions of the back of the adhesive decorations are not exposed in an assembled state. The reflection symmetry of the adhesive decorations may be particularly helpful where a tacky substance is disposed on the backs of the adhesive decoration in order to avoid exposure of the tacky substance when the adhesive decorations are in an assembled state. Alignment of the adhesive decorations back-to-back in accordance with the reflection symmetry of the adhesive decorations may be achieved by providing a first adhesive decoration and a second adhesive decoration having the same or similar design and/or shape (e.g., both adhesive decorations have the same depiction imprinted upon them and the same profile). Alignment may also be achieved by providing an adhesive decoration having the same profile, but a different depiction imprinted upon them (e.g., a first adhesive decoration having a bunny depiction and a second adhesive decoration having the profile of a bunny but a rainbow depiction). The shapes and/or profiles of the adhesive decorations may define a perimeter of the adhesive decoration. The perimeters of the adhesive decorations may be mirror images or reverse mirror images so that the perimeters align, and no adhesive is exposed. One adhesive decoration may be connected to one or more other adhesive decorations. The connection may be integrally formed. For example, adhesive decorations may be cut by the manufacturer so that the adhesive decorations are integrally connected. Two or more adhesive decorations may be connected by an attachment device (e.g., split ring). Two or more adhesive decorations may be connected by an elongate member. The adhesive decorations may include one or more edges. The one or more edges may include one or more terminal edges, peripheral edges, boundaries between integrally connected elements, boundaries between different shapes and/or profiles, or any combination thereof. The adhesive decorations may be connected at any portion of their edges. The adhesive decorations may meet at one or more edges. The adhesive decorations may be connected at an interface.

The adhesive decorations may include one or more elongate members. The elongate member may be integral to one or more adhesive decorations. The elongate member may be fastened to one or more adhesive decorations. The elongate member may extend from an adhesive decoration. The elongate member may extend from and between two or more adhesive decorations. The elongate member may include two ends. The ends may be coupled to an adhesive decoration, free, or both. The elongate member may extend from an edge of an adhesive decoration. The elongate member may be defined by a length, width, or both. The length may be about 5 mm or more, 1 cm or more, 1.5 cm or more, 2 cm or more, or even 2.5 cm or more. The length may be about 5 cm or less, 4.5 cm or less, 4 cm or less, or 3.5 cm or less, or even 3 cm or less. The width may be generally equal to or less than a width of an adhesive decoration. The elongate member may include a face, a back, or both. The face and back may be oriented in the same direction as a face and back, respectively, of an adhesive decoration. The back may include a tacky material thereon. The elongate member may wrap around a body part of a user, clothing of a user, a wearable article, a decorated article, the like, or any combination thereof. The elongate member may fold onto itself. The elongate member may adhere back-to-back to itself. The elongate member may include one or more seams.

The charm may include one or more seams. The seam may function to guide and/or ease folding of a first adhesive decoration relative to a second adhesive decoration. The seam may aid an individual in aligning a first adhesive decoration with a second adhesive decoration, an elongate member with itself, or both. The seam may be formed at the interface of two or more adhesive decorations. A seam may be formed at any portion along a length of an elongate member. The seam may be parallel to, aligned with, in-line with, form part of, or any combination thereof a reflection plane. The seam may be formed by scoring, pre-folding, perforating, compressing, the like, or any combination thereof. The seam may be formed on a face, back, or both. A seam may be formed on a back toward a face. The seam may extend at least partially a length of the interface of two or more adhesive decorations. The seam may extend at least partially a width of an elongate member. The seam may be formed at, opposite, or adjacent to one or more attachment members. The adhesive decorations may be adapted to tear at the seam. The seam may allow for matching adhesive decorations to be packaged together and easily found within a kit. The adhesive decorations may be folded back-to-back. The adhesive decorations may be folded so a tacky material disposed on the back of one or more adhesive decorations and/or elongate members contacts the back of one or more other adhesive decorations and/or elongate members. The adhesive decorations may be folded onto a body part of a user, clothing of a user, a wearable article, or any combination thereof. The adhesive decorations may at least partially sandwich a body part of a user, clothing of a user, a wearable article, or any combination thereof. The body part may include an ear, nose, finger, hair (e.g., a lock of hair), the like, or any combination thereof. The clothing may include a shirt, pants, jacket, socks, shoes, bag, bobby pin, hair claw, hair snap clips, barrettes, the like, or any combination thereof. A portion of the first adhesive decoration may be adhered to a reciprocal portion of a second adhesive, while another portion of the first adhesive decoration and second decoration are adhered to and sandwich a body part, clothing, wearable article, or the like therebetween.

The adhesive decorations may be defined by a length, width, thickness, or any combination thereof. The adhesive decorations may have a length of about 0.5 cm or more, about 1 cm or more, about 1.5 cm or more, about 10 cm or less, about 5 cm or less, or even 3 cm or less. The adhesive decorations may have a width of about 0.5 cm or more, about 1 cm or more, about 1.5 cm or more, about 10 cm or less, about 5 cm or less, or even 3 cm or less. The adhesive decorations may have a thickness of about 1 cm or less, about 0.8 cm or less, about 0.6 cm or less, about 0.01 cm or more, about 0.1 cm or more, or even about 1 cm or more. The adhesive decorations may be shaped such that they are substantially symmetrical, asymmetrical, round, oval, square, rectangular, irregular, triangular, human-like, animal-like, resembling an object, or any combination thereof.

The adhesive decorations may include stickers, puffy stickers, or both. The stickers may be substantially planar stickers having a 2D design. The puffy stickers may be 3D stickers with a depth imparted by a face extending from the longitudinal plane, lateral plane, a surface that forms a connection, or any combination thereof of the puffy sticker. The puffy stickers may have a depth varying across the face of the puffy sticker so that the puffy sticker has texture. The adhesive decorations may comprise a face, a back, a theme, a design, a filling, an attachment member, auxiliary decoration, a seam, or any combination thereof. Puffy stickers may or may not have a reduced thickness along the seam.

An adhesive decoration may include a face. The face may function to be outwardly visible to a viewer when the adhesive decorations assemble into a charm and provide a three-dimensional characteristic to the adhesive decorations. The face may include a forward surface, facing away from the back, and a rear surface, facing toward the back. The face may be integral with the back and form a forward surface facing away from the back. The face may be convex or extend outward along an axis normal to the longitudinal plane of the adhesive decoration ("depth axis"). The depth of the face may have a varying elevation. The design of the face may exhibit a three-dimensional effect. The face may be hollow (i.e., having a concave portion defining a void between the face and the back), solid (i.e., solid material extending to the back), or both. As an example of a hollow face, the face may comprise a shaped polymer sheet, with a convex side and a concave side, and the hollow portion may be the space defined by the concave side which abuts the back. As an example of a solid face, the face may comprise an open cell foam that has a flat, convex, concave, and/or otherwise non-planar side opposing a substantially flat side and the space therebetween is foam. The face may comprise resin, foam, polymer (e.g., nylon, acrylic, PVC, polyethylene, polypropylene, polycarbonate), wood, ceramic, paper, metal, or any combination thereof. The material comprising the face may be suitable for accepting and retaining pigmentation as a result of the crafter applying a design to the adhesive decoration such as by painting, coloring, drawing, or any combination thereof. More specifically, the material may be rough or porous in order for the pigment to permeate or set within the material. The face may comprise a design or may be free of a design. The face may be partially or completely opaque, translucent and/or transparent. A face that is transparent or translucent may enable a filling, a design on the back, or both to be visible. For example, the face may comprise clear polyethylene enabling a viewer to see a filling dispensed in the hollow face. The face may be embossed, where the embossment imparts a texture on the adhesive decoration, the embossment complements the design, or both.

An adhesive decoration may include a back. The back may function as a substrate for tacky material. The back may include a forward surface, facing toward the face, and a rear surface, facing away from the face. The back may be integral with the front such that the front includes a forward surface, and the back includes a rear surface. The rear surface may include a tacky material. The rear surface may be free of tacky material. For example, a first adhesive decoration may include tacky material and a second adhesive decoration may be free of tacky material. As another example, the first and second adhesive decoration may both include a tacky material. The forward surface may include a design or be free of a design. Where the forward surface includes a design, the forward surface may be visible through the face. For example, the face may be clear, and a design may be imprinted on the forward surface of the back so that the design on the back may be visible through the clear face.

An adhesive decoration may include a tacky material. The tacky material may function to adhere the adhesive decoration to a surface. The tackiness of the tacky material may be non-permanent (i.e., sufficient to enable the adhesive decoration to be removed from a surface or another adhesive decoration without damage to the adhesive decoration, the sticky substrate, or both) or permanent (i.e., not removable without damage to the adhesive decoration, the sticky substrate, or both). The tacky material may be tacky before a charm is formed. For example, the tacky material may be a one-part material or a peel and stick layer. The tacky material may be a tacky material that is used on a sticker. The tacky material may only become tacky upon connection with another tacky material. For example, the tacky material may be a two-part adhesive such that when the two tacky materials are connected together, they react and become tacky. The tacky material may be a moisture cure adhesive. The tacky material may be rubber, acrylic, acrylic blend, epoxy, one-part adhesive, two-part adhesive, or any combination thereof. The type of tacky material may be chosen in accordance with the material comprising the back.

An adhesive decoration may include or be free of a void. A void may function may be formed as a gap between the face and back. For example, an adhesive decoration may comprise a face that is a transparent polymer shell defining a void between the face and the back. The void may include a filling (e.g., glitter). The filling in the void may be visible through the face. The adhesive decoration may comprise a face comprising foam having a design imprinted upon the forward surface of the face. In another example of an adhesive decoration of the present disclosure, the adhesive decoration comprises a face comprising an epoxy resin, which is transparent, and a design imprinted upon the forward surface of the back is visible through the epoxy resin of the face.

The theme may be a single, cohesive subject of the adhesive decorations, the wearable article, or both (e.g., a person, an animal, a creature, a character, a face, an object, food, a number, a letter, a setting, a shape, a sport, a setting, or any combination thereof). The theme may comprise individual designs which conform to the theme. For example, where the theme is letters the adhesive decorations comprise designs of different letters. As another example, where the theme is medieval, the adhesive decorations comprise designs of dragons, knights, horses, castles, princesses, or any combination thereof. The adhesive decorations of a kit may include the same theme or different themes. The complementary pair of adhesive decorations may have a single theme. Complementary pairs may have a different theme. For example, a first adhesive decoration may be an emoji and a second adhesive decoration may be a soccer ball—in such case the profiles of the first adhesive decoration and the second adhesive decoration may be substantially similar and the adhesive decorations may be assembled to form a charm.

The design may function as a depiction and likeness of a subject. The design may be embodied by pigment, embossments, depressions, a profile, or any combination thereof. The design may be pigment that is fully pre-imprinted on the adhesive decorations, partially pre-imprinted on the adhesive decorations, or absent from the adhesive decorations. For example, a partially pre-imprinted design may be an outline of a design whereby the adhesive decorations are configured to have the design applied by the crafter (e.g., coloring in with marker). The design may be present on the face, the back, or both. The design may be present on a portion of the face, a portion of the back, or both. Preferably, the design is only on the face or forward surface. For example, a portion of the face may be both free of design and transparent, enabling a design present on the back to be seen. As another example, the entirety of the face may be transparent, enabling a design present on the back to be seen. The design may be pronounced by a profile.

The profile may be the shape of the adhesive decorations as projected on a plane, viewed along an axis normal to a face or back of the adhesive decoration. The profile may include the distal perimeter of the adhesive decorations, voids within the adhesive decorations extending through the adhesive decoration along the depth axis, or both. The profile may conform to the contours of a subject depicted on the adhesive decoration or may be shaped independent of the subject depicted on the adhesive decoration. For example, where the design is a cloud, the profile of the adhesive decoration conforms to the contours of the cloud. As another example, the adhesive decoration may have a circular profile, but the subject depicted on the adhesive decoration may be a horse. The profile of the first adhesive decoration and the second adhesive decoration may be mirror images or reverse mirror images of each other. The profile may include the profile of the attachment member. The profile of a complementary set of a first adhesive decoration and a second adhesive decoration may have reflection symmetry.

The subject may resemble animate life, inanimate objects, make-believe characters, settings, symbols, letters, numbers, characters, or any combination thereof. The design of an adhesive decoration may include one subject or more than one subject.

The attachment member may function to enable the adhesive decorations to attach to a wearable article. The attachment member may include an integral portion of the adhesive decorations or a component separate from the adhesive decorations. For example, an integral attachment member may be a distally extending lobe of the adhesive decoration. As another example, the attachment member may be a polymer, rubber, or metal tab that may be attached to the charm by a portion of the attachment member being sandwiched between the adhesive decorations. Each adhesive decoration may include one or more attachment members. Each adhesive decoration may include a plurality of attachment members. The attachment members may extend from a side and/or adjacent an edge of the adhesive decorations. One or more attachment members may extend from opposing sides and/or edges of the adhesive decoration. For example, each adhesive decoration may include two attachment members and the attachment members may be located on opposing sides so that a wearable article extends through a first attachment member behind the adhesive decoration or charm and out through the second attachment member. As another example, each adhesive decoration may include two attachment members, located on opposing sides thereof, a wearable article extending through the first attachment member and the second attachment member remaining free for one or more charms to be attached thereto via an attachment device. The attachment member of one adhesive decoration may be connected to one or more attachment members of one or more other adhesive decorations. For example, an attachment member of a first adhesive decoration may be affixed to an attachment member of a second adhesive decoration. The connection may be integrally formed. For example, adhesive decorations may be cut by the manufacturer so that the adhesive decorations are integrally connected by their respective attachment members. The attachment members may be connected at any portion of their edges, an interface, along a seam, or any combination thereof. The attachment members may be connected at a portion opposing the portion interfacing with their respective adhesive decorations. A seam may be formed at the interface of two or more attachment members. A seam may be formed on an edge of an adhesive decoration opposing an attachment member. The interface may be located on one or more attachment members. The attachment member may be reinforced. For example, the attachment member may be reinforced by a coating on the attachment member, a grommet applied into the attachment member, a backing on the attachment member (e.g., polymer, rubber, or metal sheet applied to the rear surface of the attachment member), or any combination thereof. The attachment member may extend between the one or more first adhesive decorations and the one or more second adhesive decorations. The attachment member may be a through-hole, a loop, a void (i.e., absence of material) on the adhesive decoration. The through-hole, loop, or void may be formed integrally in the adhesive decoration when molded, die cut during the production of the adhesive decoration, or formed by the user by punching, cutting, or threading (e.g., with a needle). The attachment member may be cuttable. The attachment member may be cut either by the manufacturer or the user to form a slit so that the through-hole, the loop, or the void is opened so that the wearable article and/or one or more attachment devices may be pushed through the slit and into the through-hole, the loop, or the void. The attachment member may include a lobe extending distally from the adhesive decoration or the attachment member may be located within the design. For example, the adhesive decoration may have the design and profile of a donut and the attachment member may be the hole in the middle of the donut. The attachment member may include a portion of the design. For example, the adhesive decoration may have the design of a cowboy swinging a lasso and the attachment member, may include a design of the lasso where the through-hole of the attachment member extends through the middle of the lasso.

An adhesive decoration may include a slit. The slit may function to receive one or more attachment devices, attachment members, other charms, the like, or any combination thereof. A slit may be formed in an attachment member or any portion of the adhesive decoration. A slit may be cut by a user. A slit may extend from an edge of the attachment member to a through-hole of the attachment member. The slit may allow for one or more attachment devices, attachment members, other charms, or the like to be inserted therethrough and affixed to the attachment member. A slit may be useful for children who cannot easily manipulate an attachment device, affixing charms together without the aid of an attachment device, and the like.

The filling may function as a movable decoration. The filling may include an aesthetic decoration for the adhesive decoration, acting alone or augmenting the design (e.g., design printed on the forward surface of the back). The filling may comprise any suitable decoration that is appropriately sized to fit within the face of the adhesive decoration. Specifically, the filling may include glitter, confetti, figures (i.e., small figures crafted to resemble objects, animals, creatures, or any combination thereof), liquid, gel, or any combination thereof. The filling may be metallic, sparkly, colored, transparent, or any combination thereof. For example, the filling may include both figures of fish and liquid where the fish are dispersed in the liquid—such a filling may complement an aquarium design printed on the forward surface of the back of the adhesive decoration. The filling may be free or fixed. Free filling may be filling that is free to travel within the adhesive decoration, either through an empty space within the adhesive decoration or within another filling (liquid) within the adhesive decoration. For example, free filling may be bound within the void (e.g., a hollow space) of a face defined by the forward surface and the rear surface. Fixed filling may be suspended in a medium. For example, suspended filling may be suspended within a cured, hardened resin comprising the face.

The wearable article may function to hold the charms and display the charms as the wearable article is worn or affixed to a decorated article for display. The wearable article may include a bracelet, a necklace, earrings, a ring, a pin, an anklet, a belt, a hair decoration, a rubber band, an O-ring, a shoelace, glasses, writing utensil, a backpack, a pin, a zipper, clothing, a bag, or any combination thereof. The hair decoration may include bobby pins, hair claws, hair snap clips, barrettes, the like, or any combination thereof. The wearable article may comprise string, a chain, a wire, monofilament, a polymer band, or a ring. The wearable article may be constructed from filament, fabric, polymer, metal, wood, or any combination thereof. The wearable article may be worn directly on a body part of the user (e.g., ear, neck, wrist, hair, ankle) or the wearable article may be affixed to a decorated article so that the adhesive decoration is displayed on the decorated article (e.g., pencil, pen, backpack, jacket, glasses).

The attachment member may include a shoelace attachment that may function to accept a shoelace so that the shoelace attachment can be affixed to a shoe. The shoelace attachment may comprise a central portion, which is configured to be sandwiched between two of the adhesive decoration, and two lobed portions, which comprise attachment members.

The O-ring may function to accept articles of substantially uniform cross-sectional length. For example, the O-ring may be slid or rolled onto the end of a writing utensil. The O-ring and the attachment device may be substantially the same. The O-ring may be an attachment device that is specifically tailored to connect to a writing utensil.

The attachment device may function to connect a charm to a wearable article and/or another charm. The attachment device may provide for a permanent connection (i.e., not removable without substantial effort or damage to the charm, the attachment device, the wearable article, or any combination thereof) or a removable connection. The attachment device may engage one or more attachment members. The attachment device may include a ring that loops through both the charm and the wearable article. The attachment device may comprise a split ring, jump ring, crimp end bead tip, ball and coil ear wires, lobster clasp, bails, crimp bead, hooks, string, monofilament, wire, magnets, glue, tape, a post, or any combination thereof. For example, a split ring may be opened and applied to both a charm and a chain (wearable article) and thereafter closed to secure a charm to a link of the chain. As another example, the charm may be applied to a ring with hot-melt glue. As yet another example, the adhesive decorations of the charm may be applied back-to-back with a post in the middle where the post extends from a ring. More than one attachment device may be utilized in connecting a single charm. For example, a first split ring may be guided through the attachment member and closed by moving the ends together and a second split ring may be guided through the first split ring and the wearable article and closed by moving the ends together. More than one attachment device may accept more than one adhesive decoration. For example, two charms may be affixed to two discrete split rings and the respective split rings may be closed, the two discrete charms and split rings may be applied onto a single split ring. The fashion accessory may be free of an attachment device. More specifically, the charm may be configured to attach to the wearable article (e.g., a string) by enclosing the wearable article in-between the first bubble charm and the second bubble charm.

The fashion accessory may comprise auxiliary decoration, which may function to add decorative elements to the fashion accessory. The auxiliary decoration may comprise, beads, stickers (non-adhesive decorations), pendants, string, chains, pre-fabricated charms, markers, pen, pencil, crayon, paint, glitter, any other suitable decorative element, or any combination thereof. The auxiliary decoration may be employed to enhance the aesthetics of the fashion accessory, to give the crafter a wider range of creative choices, to extend the intriguing life of the fashion accessory, or any combination thereof. The auxiliary decoration may be employed on any portion of the fashion accessory or not at all. For example, the auxiliary decoration may comprise beads, which may be applied to a necklace in between charms. As another example, the auxiliary decoration may be paint configured for use on charms, where the constituent adhesive decorations are purposely left blank for the crafter to paint. As yet another example, the auxiliary decoration may be pen so that that the crafter may write their name on an adhesive decoration configured with a space for writing.

FIG. 1 illustrates a plan view of a fashion accessory 10 comprising a wearable article 90, which is a necklace, and a charm 20.

Figure 2A:
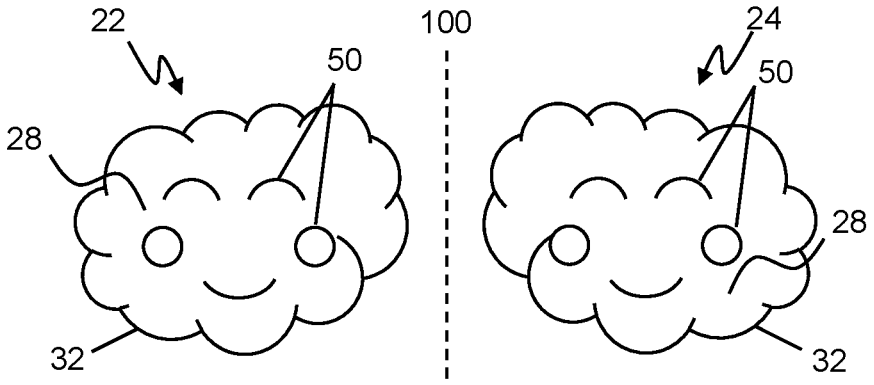
FIG. 2A is a plan view of a first adhesive decoration and a second adhesive decoration.

FIG. 2A illustrates a plan view of the face 28 of a first adhesive decoration 22 and a second adhesive decoration 24. The first adhesive decoration 22 and the second adhesive decoration 24 comprises profiles 32, shown as clouds, and designs 50, which are displayed as a smiling, blushing emoji. The profiles 32 and designs 50 of the first adhesive decoration 22 and the second adhesive decoration 24 exhibit reflection symmetry along a reflection plane 100.

Figure 2B:
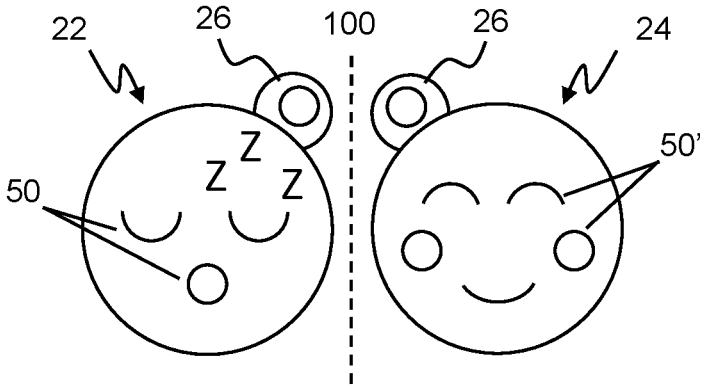
FIG. 2B is a plan view of a first adhesive decoration and a second adhesive decoration having attachment members.

FIG. 2B illustrates a plan view of a first adhesive decoration 22 and a second adhesive decoration 24. The first adhesive decoration 22 and the second adhesive decoration 24 include attachment members 26 and designs 50, 50'. The attachment members 26 extend distally from the first adhesive decoration 22 and the second adhesive decoration 24 and are oriented with reflection symmetry along a reflection plane 100. The design 50 of the first adhesive decoration 22 is shown as a sleeping emoji and the design 50' of the second adhesive decoration 24 is shown as a smiling, blushing emoji. The designs 50, 50' are oriented in the same direction with respect to the attachment members 26.

Figure 3:
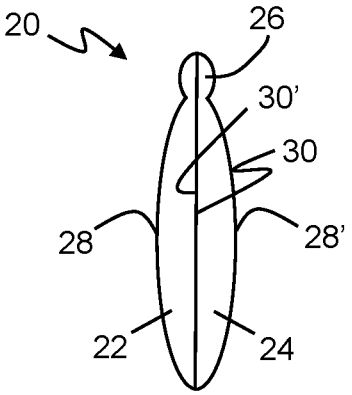
FIG. 3 is a side view of a charm.

FIG. 3 illustrates a side view of a charm 20 comprising a first adhesive decoration 22 and a second adhesive decoration 24 affixed together. The backs 30, 30' of the first adhesive decoration 22 and the second adhesive decoration 24 are affixed together back-to-back; the faces 28, 28' of the first adhesive decoration 22 and the second adhesive decoration 24 are oriented away from each other. The charm 20 includes one or more attachment members 26.

Figure 4:
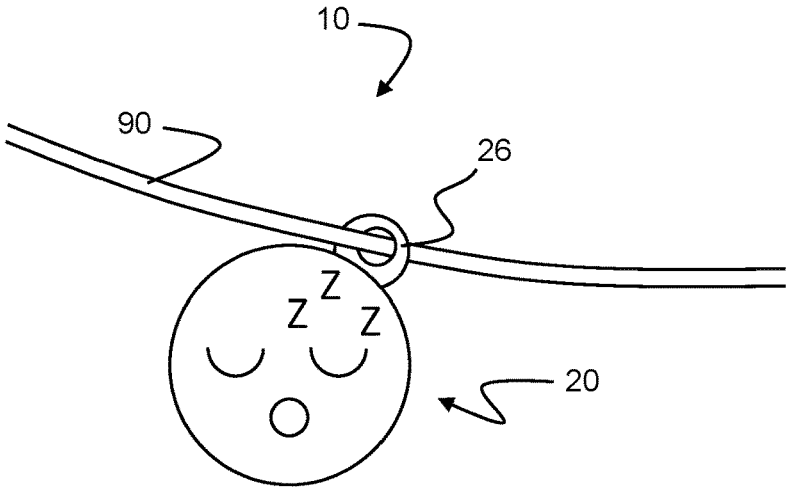
FIG. 4 is a plan view of a charm attached to a wearable article.

FIG. 4 illustrates a plan view of a fashion accessory 10 with a charm 20 affixed to a wearable article 90. The wearable article 90 is displayed as a string, threaded through one or more attachment members 26 on the charm 20.

Figure 5:
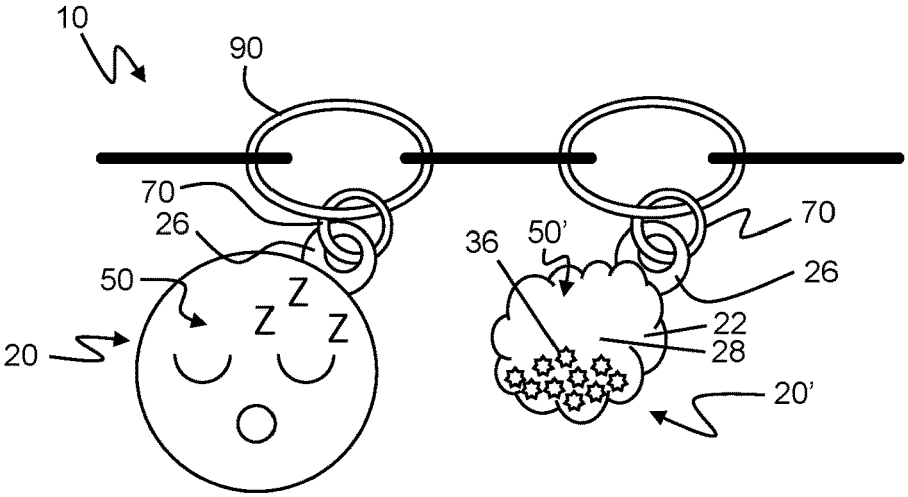
FIG. 5 is a plan view of two charms attached to a wearable article.

FIG. 5 illustrates a plan view of a fashion accessory 10 with two charms 20, 20' affixed to a wearable article 90, which is shown as a chain. The charms 20, 20' include a sleepy emoji design 50 and a cloud design 50'. The two charms 20, 20' include attachment members 26. The attachment members 26 are attached to the wearable article 90 by attachment devices 70, which are shown as split rings. The charm 20' comprises filling 36 (glitter), visible through the face 28 of the first adhesive decoration 22.

Figure 6:
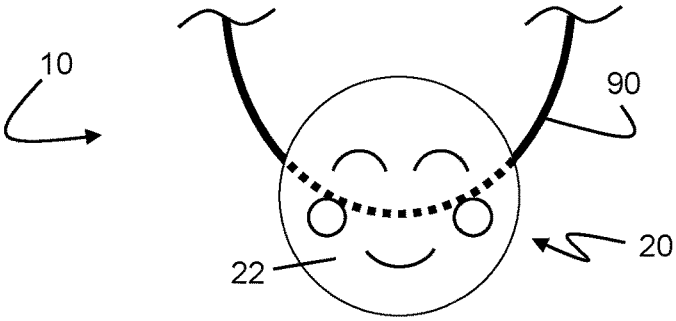
FIG. 6 is a plan view of a charm attached to a wearable article.

FIG. 6 illustrates a plan view of a fashion accessory 10 with a charm 20 affixed to a wearable article 90, which is shown as a string. The charm 20 includes a first adhesive decoration 22 and a second adhesive decoration (not shown), which are affixed together back-to-back with the wearable article 90 in between.

Figure 7:
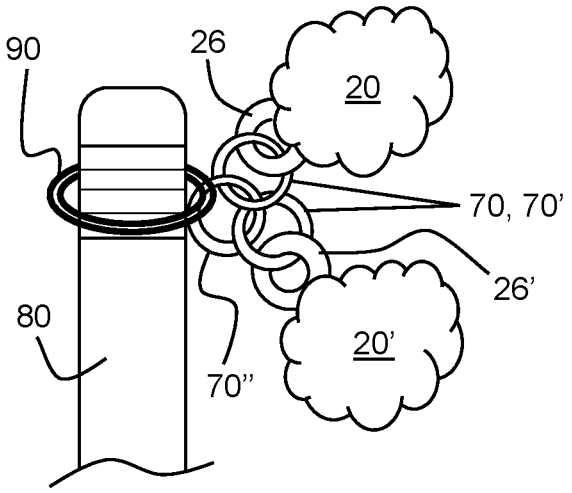
FIG. 7 is a plan view of a charm attached to a wearable article, which is applied to the end of a writing utensil.

FIG. 7 illustrates two charms 20, 20' attached to a decorated article 80. Each of the two charms 20, 20' comprise attachment members 26, 26', through each of which an attachment device passes 70, 70'. The attachment devices 70, 70' are connected via a third attachment device 70", which is attached to a wearable article 90, which is an o-ring. The wearable article 90 is applied on a decorated article 80, which is a pencil, over the eraser end.

Figure 8:
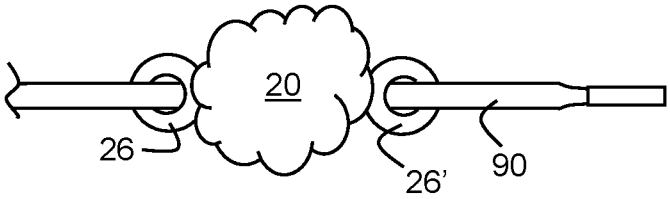
FIG. 8 is a plan view of a charm attached to a wearable article.

FIG. 8 illustrates a charm 20 attached to a wearable article 90. The charm 20 includes two attachment members 26, 26' which extend distally from the charm 20 in opposing directions. The wearable article 90, which is a shoelace, is threaded through one attachment member 26, behind the charm, and up through the other attachment member 26'.

Figure 9:
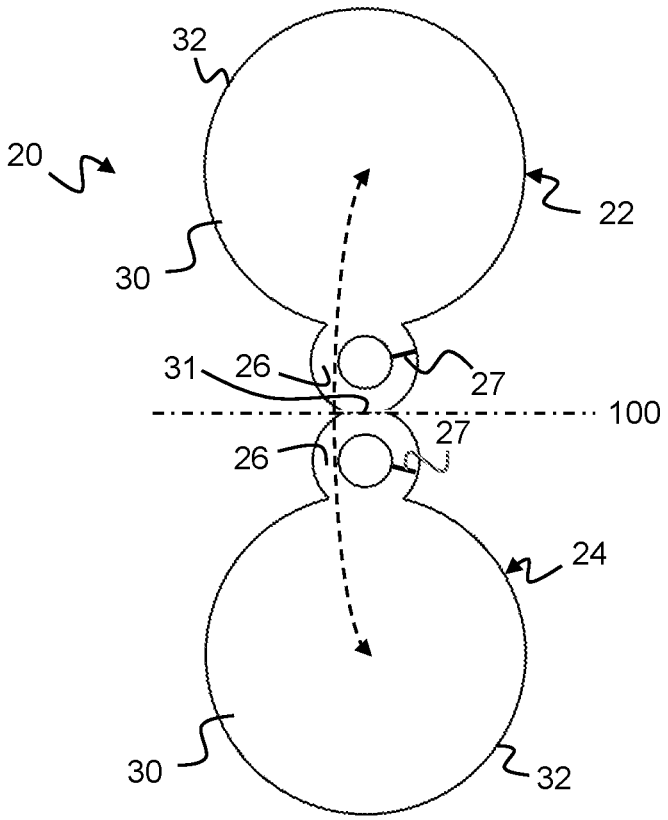
FIG. 9 is a plan view of a charm.

FIG. 9 is a plan view of a charm 20. The charm 20 is in an unfolded configuration. The charm 20 comprises a first adhesive decoration 22 and a second adhesive decoration 24. The first adhesive decoration 22 and the second adhesive decoration 24 each include an attachment member 26. The attachment member 26 extends distally therefrom. The attachment members 26 of the first adhesive decoration 22 and the second decoration 24 are connected to each other at their edges. The first adhesive decoration 22 is integral with the second adhesive decoration 24. A seam 31 is formed along a length of the interface of the attachment members 26. The seam 31 is aligned with the reflection plane 100 such that the profiles 32 of the first and second adhesive decorations 22, 24 are mirrored about the seam 31. The seam 31 aids in folding the first adhesive decoration 22 and the second adhesive decoration 24 onto each other. The first adhesive decoration 22 and the second adhesive decoration 24 include slits 27 extending from an edge of the attachment members 26 to a through-hole of the attachment members 26. The location of the slits 27 is symmetrical about the reflection plane 100. A back 30 of the first adhesive decoration 22 and a back 30 of the second adhesive decoration 24 are arranged to interface with each other when the first adhesive decoration 22 and the second adhesive decoration 24 fold with respect to one another.

Figure 10:
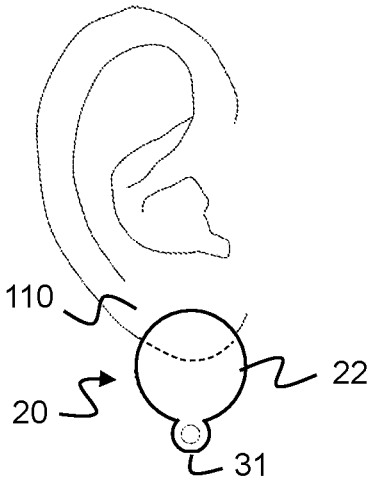
FIG. 10 is a perspective view of the charm, illustrated in FIG. 9, being worn on an ear lobe.

FIG. 10 is a perspective view of the charm 20, illustrated in FIG. 9, being worn on an ear lobe 110. The first adhesive decoration 22 and second adhesive decoration 24 are folded at the seam 31 to form the charm 20. The first adhesive decoration 22 is located on one side of the ear lobe 110 and the second adhesive decoration 22 is located on an opposing side of the ear lobe 110, sandwiching a portion of the ear lobe 110. The charm 20 is retained on the ear lobe 110 by adhesive disposed on the backs of the first adhesive decoration 22 and the second adhesive decoration 24, as illustrated in FIG. 3.

Figure 11:
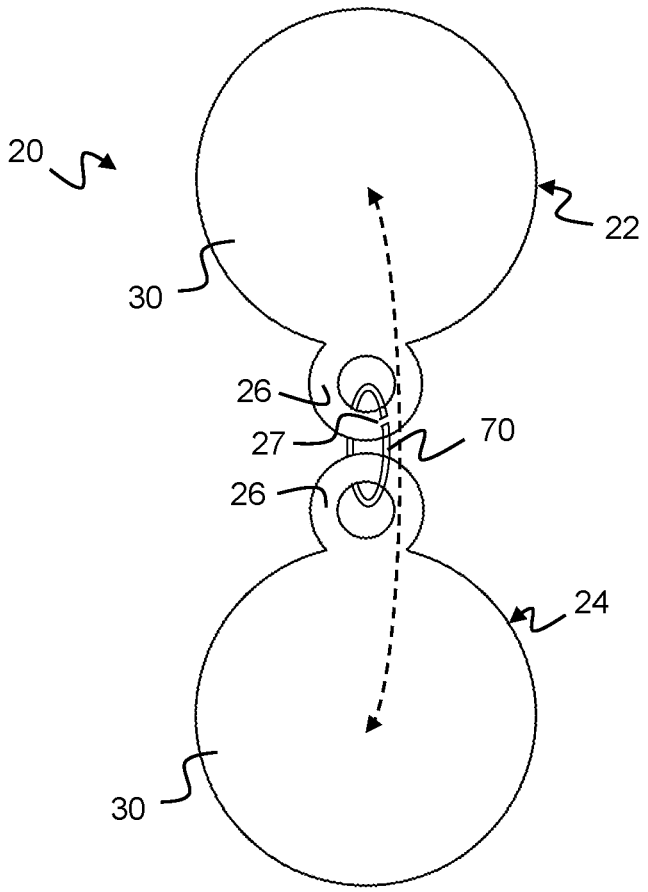
FIG. 11 is a plan view of a charm.

FIG. 11 is a plan view of a charm 20. The charm 20 comprises a first adhesive decoration 22 and a second adhesive decoration 24. The first adhesive decoration 22 and the second adhesive decoration 24 each include an attachment member 26 extending distally therefrom. The attachment members 26 each include a slit 27. The attachment members 26 of the first adhesive decoration 22 and the second decoration 24 are connected to each other by an attachment device 70. The attachment device 70 includes a slit 27. The attachment device 70 can be inserted to each attachment member 26 via the respective slit 27 and/or the slit 27 of the attachment device. The attachment device 70 connects the first adhesive decoration 22 to the second adhesive decoration 24. The attachment device 70 also provides a hinge for the first adhesive decoration 22 and the second adhesive decoration 24 to fold about and onto each other. A back 30 of the first adhesive decoration 22 and a back 30 of the second adhesive decoration 24 are arranged to interface with each other when the first adhesive decoration 22 and the second adhesive decoration 24 translate along the attachment device 70 to fold with respect to one another.

Figure 12:
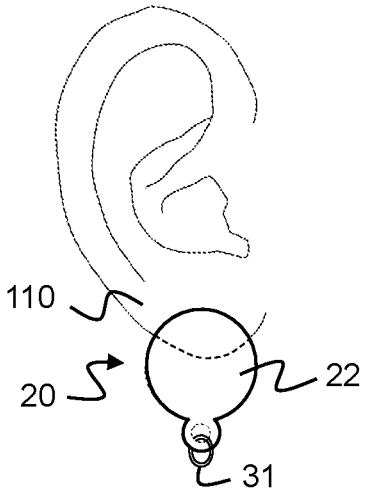
FIG. 12 is a perspective view of a charm, illustrated in FIG. 11, being worn on an ear lobe.

FIG. 12 is a perspective view of a charm 20, illustrated in FIG. 11, being worn on an ear lobe 110. The first adhesive decoration 22 and second adhesive decoration 24 translate along the attachment device 70 and fold onto the ear lobe 110. The first adhesive decoration 22 is located on one side of the ear lobe 110 and the second adhesive decoration 22 is located on an opposing side of the ear lobe 110, sandwiching the ear lobe 110. The charm 20 is retained on the ear lobe 110 by adhesive disposed on the backs of the first adhesive decoration 22 and the second adhesive decoration 24, as illustrated in FIG. 3.

Figure 13:
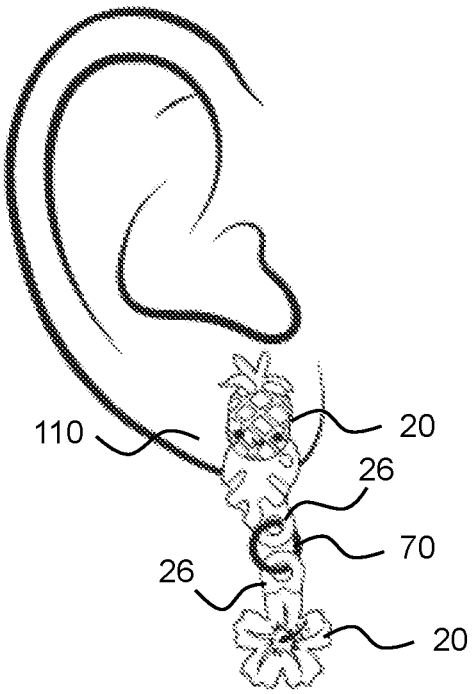
FIG. 13 is a perspective view of charms being worn on an ear lobe.

FIG. 13 is a perspective view of charms 20 being worn on an ear lobe 110. A first charm 20 is folded onto the ear lobe 110. The first charm 20 includes an attachment member 26 coupled to an attachment device 70, depending from the attachment member 26. The attachment device 70 is coupled to an attachment member 26 of a second charm 20 so that the second charm 20 depends from the first charm 20.

Figure 14:
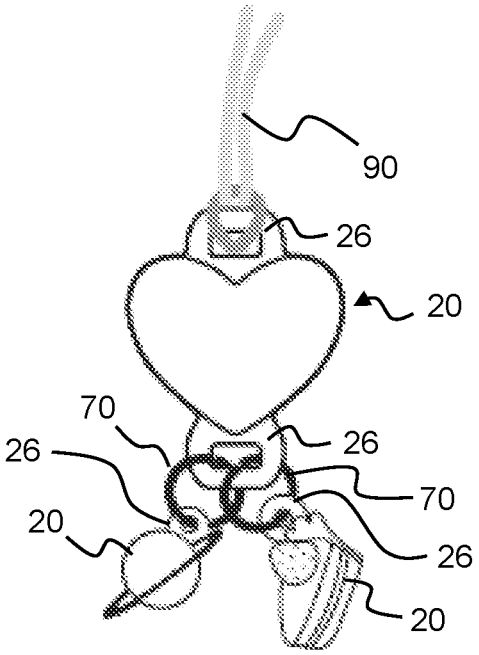
FIG. 14 is a perspective view of charms.

FIG. 14 is a perspective view of charms 20. A first charm 20 comprises two attachment members 26 located on opposing edges of the first charm 20. A wearable article 90 is coupled to one of the attachment members 26. The other attachment member 26 is coupled to two attachment devices 70 depending therefrom, which in turn are coupled to a second charm 20 and third charm 20, respectively. The second charm 20 and third charm 20 depend from the first charm 20.

Figure 15:
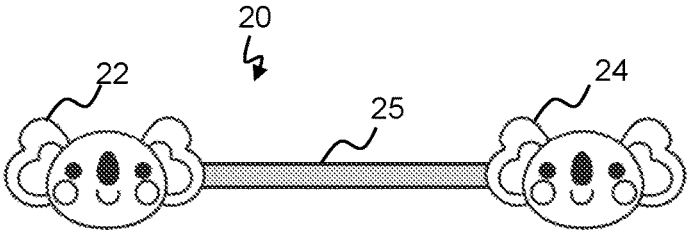
FIG. 15 is a plan view of a charm.
Figure 16:
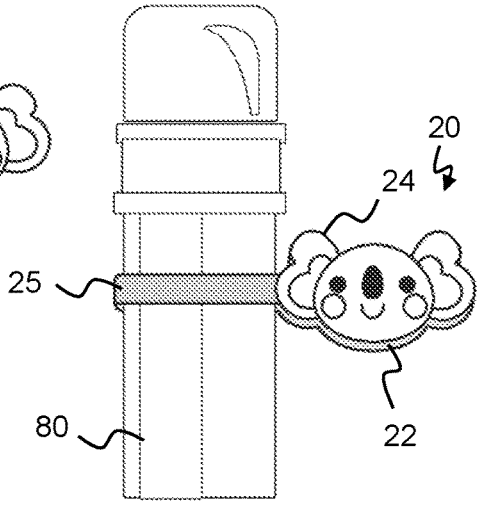
FIG. 16 is a perspective view of a charm on a decorated article.

FIGS. 15 and 16 illustrate a charm 20. The charm 20 comprises a first adhesive decoration 22 and a second adhesive decoration 24 linked by an elongate member 25. The elongate member 25 is coupled to and extends between the first adhesive decoration 22 and the second adhesive decoration 24. The elongate member 25 wraps around a decorated article 80, and the first adhesive decoration 22 is adhered back-to-back with the second adhesive decoration 24, as shown in FIG. 16.

Figure 17:
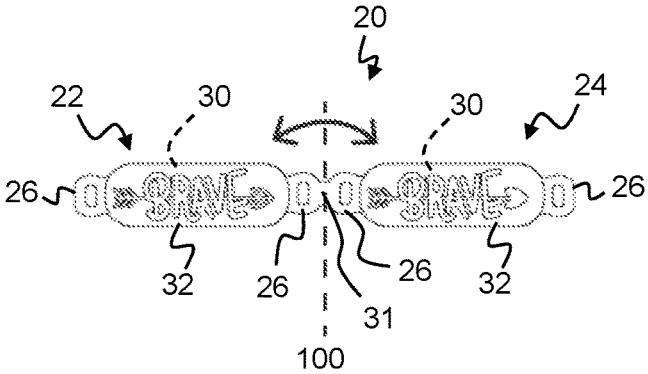
FIG. 17 is a plan view of a charm.
Figure 18:
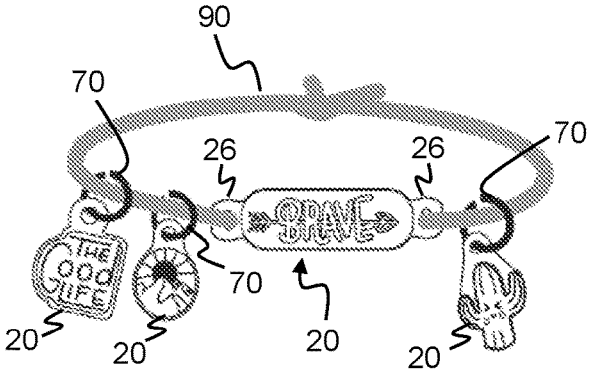
FIG. 18 is a perspective view of charms on a wearable article.

FIGS. 17 and 18 illustrate a charm 20. The charm 20 comprises a first adhesive decoration 22 and a second adhesive decoration 24. The first and second adhesive decoration 22, 24 each include two attachment members 26 located on opposing edges of each of the first and second adhesive decoration 22, 24. An attachment member 26 of the first adhesive decoration 22 and an attachment member 26 of the second decoration 24 are connected to each other at their edges. A seam 31 is formed along a length of the interface of the attachment members 26. The seam 31 is aligned with the reflection plane 100 such that the profiles 32 of the first and second adhesive decorations 22, 24 are mirrored about the seam 31. The seam 31 aids in folding the first adhesive decoration 22 and the second adhesive decoration 24 onto each other. A back 30 of the first adhesive decoration 22 and a back 30 of the second adhesive decoration 24 are arranged to interface with each other when the first adhesive decoration 22 and the second adhesive decoration 24 fold with respect to one another. The charm 20 is coupled to a wearable article 90 via the attachment members 26 thereof, as shown in FIG. 18. The wearable article 90 also includes three other charms 20 coupled to the wearable article 90 via attachment devices 70.

Figure 19:
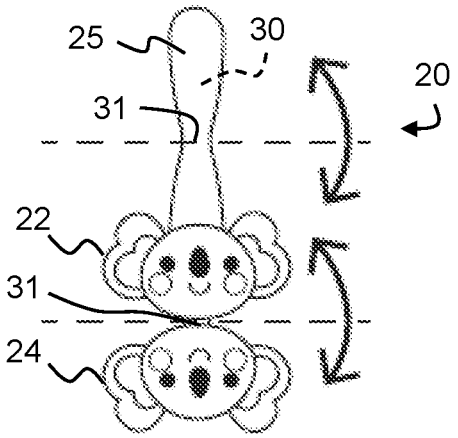
FIG. 19 is a plan view of a charm.
Figure 20:
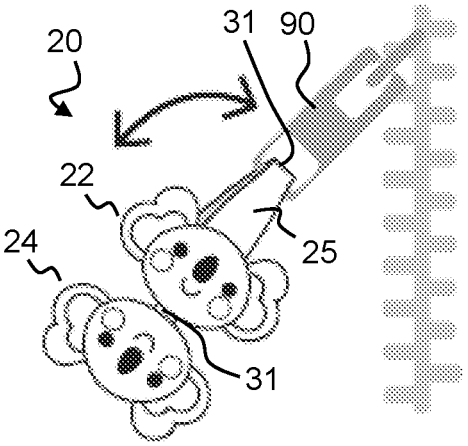
FIG. 20 is a perspective view of a charm on a wearable article.
Figure 21:
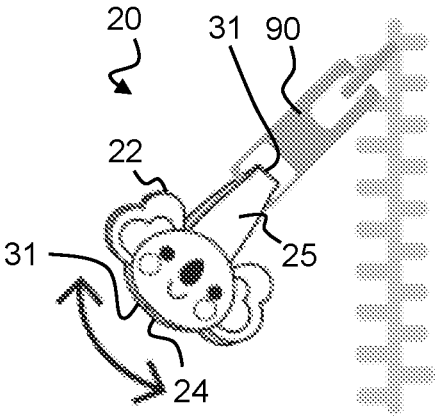
FIG. 21 is a perspective view of a charm on a wearable article.

FIGS. 19-21 illustrate a charm 20. The charm 20 comprises a first adhesive decoration 22, a second adhesive decoration 24, and an elongate member 25. The first adhesive decoration 22 and the second adhesive decoration 24 are connected at their edges. A seam 31 is formed along a length of the interface of the first and second adhesive decorations 22, 24. The elongate member 25 is coupled to the first adhesive decoration 22 at one end and the other end is free. The elongate member 25 includes a seam 31 formed thereon. The charm 20 is affixed to a wearable article 90 via the elongate member 25, as shown in FIGS. 20-21. The elongate member 25 folds around the wearable article 90 and onto itself. The first and second adhesive decorations 22, 24 are folded onto each other about the seam 31, as shown in FIG. 21, sandwiching the free end of the elongate member 25.

Plural elements or steps can be provided by a single integrated element or step. Alternatively, a single element or step might be divided into separate plural elements or steps.

The disclosure of "a" or "one" to describe an element or step is not intended to foreclose additional elements or steps.

While the terms first, second, third, etc., may be used herein to describe various elements, components, regions, layers and/or sections, these elements, components, regions, layers and/or sections should not be limited by these terms. These terms may be used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The disclosures of all articles and references, including patent applications and publications, are incorporated by reference for all purposes. Other combinations are also possible as will be gleaned from the following claims, which are also hereby incorporated by reference into this written description. The term "consisting essentially of" to describe any combination shall include the elements, ingredients, components, or steps identified, and such other elements ingredients, components or steps that do not materially affect the basic and novel characteristics of the combination. The use of the terms "comprising" or "including" to describe combinations of elements, ingredients, components, or steps herein also contemplates embodiments that consist essentially of the elements, ingredients, components, or steps.

REFERENCE NUMERALS

10 Fashion accessory
20 Charm
22 First adhesive decorations
24 Second adhesive decorations
25 Elongate member
26 Attachment member
27 Slit
28 Face
30 Back
31 Seam
32 Profile
36 Filling
40 Auxiliary decoration
50 Design
70 Attachment device
80 Decorated article
90 Wearable article
100 Reflection plane
110 Ear lobe

What is claimed is:

1. A fashion accessory comprising:

a first adhesive decoration and a second adhesive decoration connected at an interface; and a seam extending at least partially a length of the interface;

wherein each of the first adhesive decoration and second adhesive decoration comprise a face and a back, the face including a design;

wherein the first adhesive decoration and second adhesive decoration comprise foam, the foam extending between the face and the back;

wherein the first adhesive decoration is mated, back-to-back, with the second adhesive decoration to form a charm;

wherein the first adhesive decoration and second adhesive decoration include one or more attachment members integrally formed thereto, said one or more attachment members include a lobe extending distally from the first adhesive decoration and second adhesive decoration, the lobe including a through-hole extending therethrough; and further including an attachment device that engages the one or more attachment members of both the first adhesive decoration and second adhesive decoration;

wherein the attachment device includes a ring that selectively opens and closes so that the first adhesive decoration and/or second adhesive decoration are capable of being selectively engaged and disengaged by the attachment device.

2. The fashion accessory according to claim 1, further comprising a wearable article;

wherein the first adhesive decoration and second adhesive decoration fold, at the seam, onto the wearable article; and wherein the wearable article is sandwiched between the back of the first adhesive decoration and the back of the second adhesive decoration.

3. The fashion accessory according to claim 2, wherein the wearable article includes a necklace, a bracelet, a ring, an earring, a pin, an anklet, a belt, a hair decoration, or any combination thereof.

4. The fashion accessory according to claim 1, wherein the first adhesive decoration and second adhesive decoration are adapted to fold, at the seam, onto a body part, clothing, or both.

5. The fashion accessory according to claim 1, wherein the interface is located on, opposite, and/or adjacent to the one or more attachment members.

6. The fashion accessory according to claim 5, wherein the interface is located opposite the one or more attachment members.

7. The fashion accessory according to claim 1, wherein the interface is located at a portion of respective edges of the first adhesive decoration and second adhesive decoration.

8. The fashion accessory according to claim 1, wherein the seam is formed by scoring, compressing, pre-folding, perforating, or any combination thereof.

9. The fashion accessory according to claim 1, wherein the back includes a peel and stick adhesive thereon; and wherein the peel and stick adhesive is selected from a rubber, an acrylic, an acrylic blend, an epoxy, a one-part adhesive, a two-part adhesive, or any combination thereof.

10. A kit for a fashion accessory, the kit comprising:

a first adhesive decoration and a second adhesive decoration connected at an interface; and one or more wearable articles;

wherein a seam extends at least partially a length of the interface, the seam being formed by scoring, compressing, pre-folding, perforating, or any combination thereof;

wherein each of the first adhesive decoration and second adhesive decoration comprise a face and a back, the face including a design;

wherein the first adhesive decoration and second adhesive decoration comprise foam, the foam extending between the face and the back;

wherein the first adhesive decoration and second adhesive decoration include one or more attachment members integrally formed thereto, the one or more attachment members including a lobe extending distally from the first adhesive decoration and second adhesive decoration, the lobe including a through-hole extending therethrough;

wherein the interface is located on, opposite, and/or adjacent to the one or more attachment members, on a portion of respective edges of the first adhesive decoration and second adhesive decoration, or both;

wherein the back includes a peel and stick adhesive thereon;

wherein the peel and stick adhesive is selected from a rubber, an acrylic, an acrylic blend, an epoxy, a one-part adhesive, a two-part adhesive, or any combination thereof;

wherein the first adhesive decoration is mated, back-to-back, with the second adhesive decoration to form a charm;

wherein the first adhesive decoration and second adhesive decoration fold, at the seam, onto the one or more wearable articles; and wherein the one or more wearable articles are sandwiched between the back of the first adhesive decoration and the back of the second adhesive decoration.

11. The kit according to claim 10, wherein the wearable article includes a necklace, a bracelet, a ring, an earring, a pin, an anklet, a belt, a hair decoration, or any combination thereof.

12. The kit according to claim 10, wherein the first adhesive decoration and second adhesive decoration are adapted to fold, at the seam, onto a body part, clothing, or both.

13. The kit according to claim 10, further including an attachment device that engages the one or more attachment members of both the first adhesive decoration and second adhesive decoration.

14. The kit according to claim 10, wherein the interface is located opposite the one or more attachment members.

15. A method for constructing the fashion accessory of claim 10, including:

folding the first adhesive decoration and the second adhesive decoration along the seam; and mating the first adhesive decoration, back-to-back, with the second adhesive decoration to form a charm.

* * * * *